US006604530B1

(12) United States Patent
Rogari et al.

(10) Patent No.: US 6,604,530 B1
(45) Date of Patent: Aug. 12, 2003

(54) PORTABLE RECEPTACLE FOR EXTINGUISHING AND STORING CIGARETTE ENDS

(76) Inventors: Georgia Rogari, Platonos 15, 166 75 Glyfada (GR); Panayiotis Rogaris, Platonos 15, 166 75 Glyfada (GR)

( * ) Notice: Subject to any disclaimer, the term of this patent is extended or adjusted under 35 U.S.C. 154(b) by 0 days.

(21) Appl. No.: 09/807,288

(22) PCT Filed: Oct. 19, 1999

(86) PCT No.: PCT/GR99/00041

§ 371 (c)(1),
(2), (4) Date: Apr. 11, 2001

(87) PCT Pub. No.: WO00/22947

PCT Pub. Date: Apr. 27, 2000

(30) Foreign Application Priority Data

Oct. 20, 1998 (GR) ..... 980100388

(51) Int. Cl.[7] ..... A24F 19/14; A24F 15/18

(52) U.S. Cl. ..... 131/235.1; 131/236; 131/231; 131/238; 131/239; 131/237.5; 131/256; 131/242; 206/246; 206/264; 206/265; 206/257; 206/251; 206/256; 206/267; 220/523; 220/524; 220/526

(58) Field of Search ..... 131/235.1, 236, 131/231, 238, 239, 237.5, 256, 242; 206/246, 264, 265, 257, 251, 256, 268, 267; 220/526, 524, 523

(56) References Cited

U.S. PATENT DOCUMENTS

| | | | | | |
|---|---|---|---|---|---|
| 1,928,041 | A | * | 9/1933 | Windesheim | 206/496 |
| 2,596,773 | A | | 5/1952 | Horikawa | |
| 2,620,805 | A | | 12/1952 | Page et al. | |
| 2,901,097 | A | * | 8/1959 | Tamarin | 206/267 |
| 2,996,068 | A | * | 8/1961 | Bosko et al. | 131/237 |
| 3,888,264 | A | | 6/1975 | Baclit | |
| 3,920,028 | A | * | 11/1975 | Kobayakawa | 131/236 |
| 4,094,326 | A | * | 6/1978 | Newman | 131/234 |

FOREIGN PATENT DOCUMENTS

| | | |
|---|---|---|
| DE | 34 42 106 | 5/1986 |
| FR | 879334 | 2/1943 |
| FR | 2 756 708 | 6/1998 |
| JP | 09 121830 | 5/1997 |

* cited by examiner

*Primary Examiner*—Steven P. Griffin
*Assistant Examiner*—Dionne A. Walls

(57) ABSTRACT

A portable receptacle for extinguishing and storing cigarette ends is described, which comprises two distinct, functionally independent, unequally sized chambers, one smaller chamber being equipped with a fire extinguishing substance for extinguishing a cigarette after use and the other larger chamber providing the space of collection of ashes during smoking and of the cigarette ends which have been previously safely extinguished through their immersion into the chamber containing the fire extinguishing substance. Additionally, the fire extinguishing substance containing chamber may constitute a means for extinguishing cigarettes in table ashtrays of an otherwise conventional form.

7 Claims, 4 Drawing Sheets

PORTABLE RECEPTACLE FOR EXTINGUISHING AND STORING CIGARETTE ENDS

The present invention relates to a portable receptacle, which comprises two distinct, functionally independent, unequally sized chambers, one smaller chamber being equipped with a fire extinguishing substance for extinguishing a cigarette after use and the other larger chamber providing the space of collection of ashes during smoking and of the cigarette ends which have been previously safely extinguished through their immersion into the chamber containing the fire extinguishing substance.

It is well-known that smoking outdoors and/or in public areas can create adverse and often hazardous effects, which range from pollution caused to such areas wherein smokers throw cigarette ends to the hazardous effects of such cigarette ends becoming the cause of fire resulting to substantial damages.

Moreover, smoking indoors, in houses, offices, restaurants, hotels, motor cars, etc., and using conventional ashtrays also results to adverse effects such as the undesirable view of a filthy ashtray filled with cigarette ends and the appalling smell deriving therefrom and spread throughout the space.

It is therefore the object of the present invention to overcome the above mentioned adverse effects encountered during smoking by providing a means for extinguishing cigarette ends, which is a fire extinguishing substance packed into a container which is provided with an opening via which the cigarette is immersed within the fire extinguishing substance and is thereby extinguished, wherein said container with the fire extinguishing substance content may be alternatively provided in a combination with a conventional ashtray and with a portable receptacle for storing the previously extinguished cigarette ends.

It is a further object of the invention to provide a portable receptacle divided into two distinct, functionally independent chambers, one of which is the above mentioned container of fire extinguishing substance and the other one is the space of collection of ashes and cigarette ends, wherein this portable receptacle preferably takes the overall form or a packet of cigarettes thereby being a handy to use and discreet to carry device which is further provided with airtight closure means.

It is a further object of the invention to provide the above mentioned portable receptacle with a surface whereupon is attached a sticker means to enable fixedly or removably mounting the receptacle onto a surface suitable for usage, such as the surface of a motor car driving panel and the like.

Another object of the invention is to provide alternative combinations of the proposed receptacle for extinguishing and storing cigarette ends with desired selection of smoking related articles, such as a lighter, a box of matches, a packet of cigarettes, etc., where the same sticker means carrying surface is used for adhering the receptacle onto the above smoking related articles.

These and other objects and characteristics of the invention will be made apparent to those skilled in the art by reference to preferred embodiments shown in the accompanying drawings, wherein.

Figure 1:
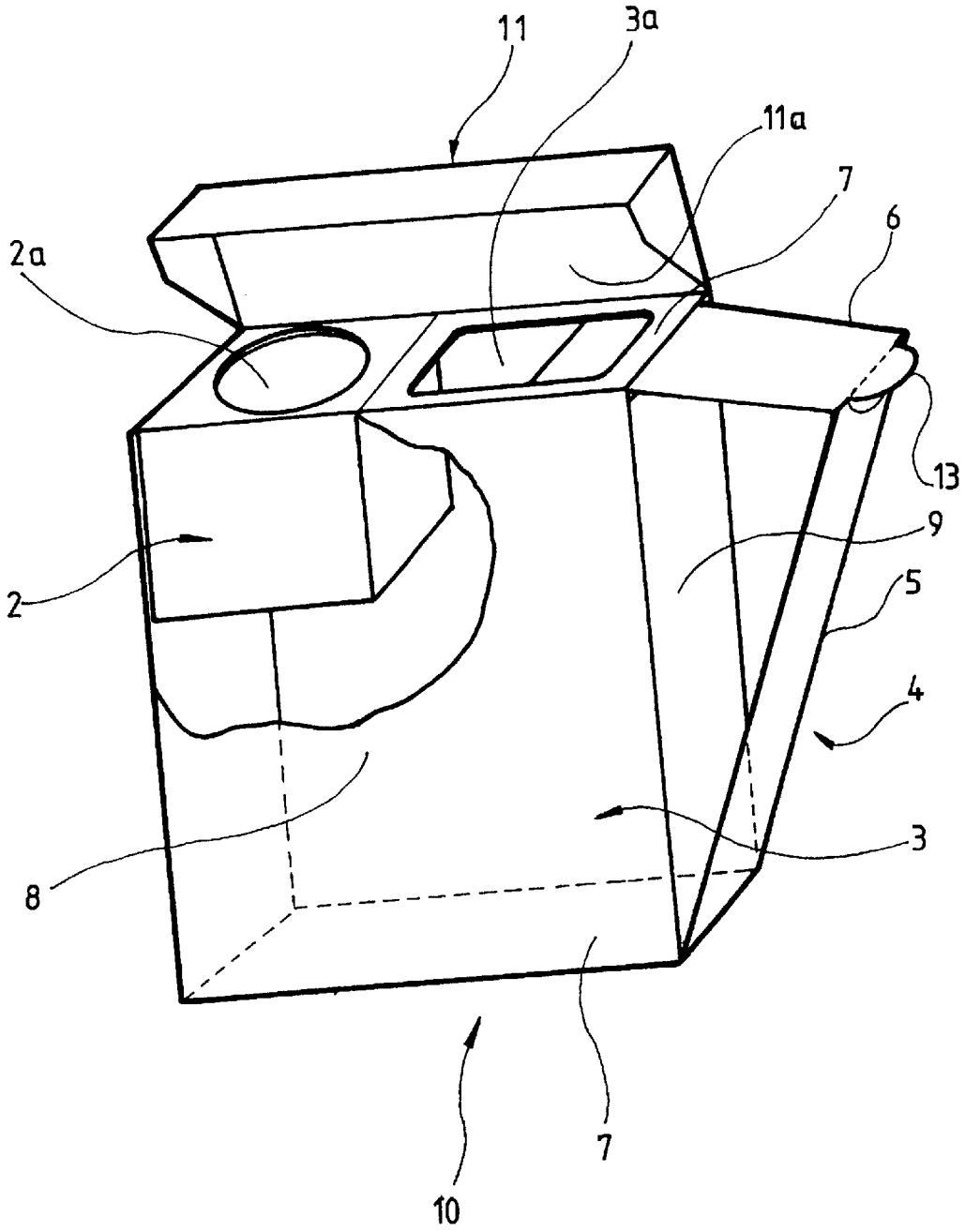
FIG. 1 shows a perspective view of a first illustrative embodiment of the receptacle of the invention.

In accordance to a first illustrative preferred embodiment of the invention shown in FIG. 1, the receptacle 10 for extinguishing and storing cigarette ends is made in the overall form and approximate sizing of a packet of cigarettes, therefore comprising a generally rectangular housing 1 which is closed by a rotatable top cover 11, wherein the rectangular housing 1 is formed by a pair of relatively large parallel front and rear surfaces 8, a pair or relatively small parallel side surfaces 9 and a pair of parallel top and bottom surfaces 7 which, when the top cover 11 is closed, acquire a parallel orientation in relation to the upper surface 11*a* of the top cover 11.

The interior of the rectangular housing 1 of the receptacle is shown divided into two distinct, functionally independent, unequally sized chambers 2 and 3, wherein the smaller chamber 2 is being equipped with a fire extinguishing substance for extinguishing a cigarette after use, and the other larger chamber 3 is the space of collection of the ashes during smoking and of previously extinguished cigarette ends after smoking.

The fire extinguishing substance containing chamber 2 is provided with a top opening 2*a* via which the cigarette is immersed into chamber 2 in order to be extinguished, whereas the larger chamber 3 wherein cigarette ends are disposed is provided with a top opening 3*a* via which cigarette ends are thrown for disposal following their extinguishing within chamber 2.

In order to effect an airtight closure of the receptacle, the top openings 2*a* and 3*a* are closed by means of an illustrative embodiment of closure means 4, comprising a sideways extending surface 5 connected to the bottom surface 7 of the rectangular receptacle 1 and extending to an upper surface 6 which is slidably inserted on top of the top surface 7 of the rectangular housing 1 of receptacle 10 to cover the top openings 2*a* and 3*a*. A handling fixture 13 extends at the junction of surfaces 5, 6 of the closure means 4 to facilitate operating of the closure means 4.

Figure 2:
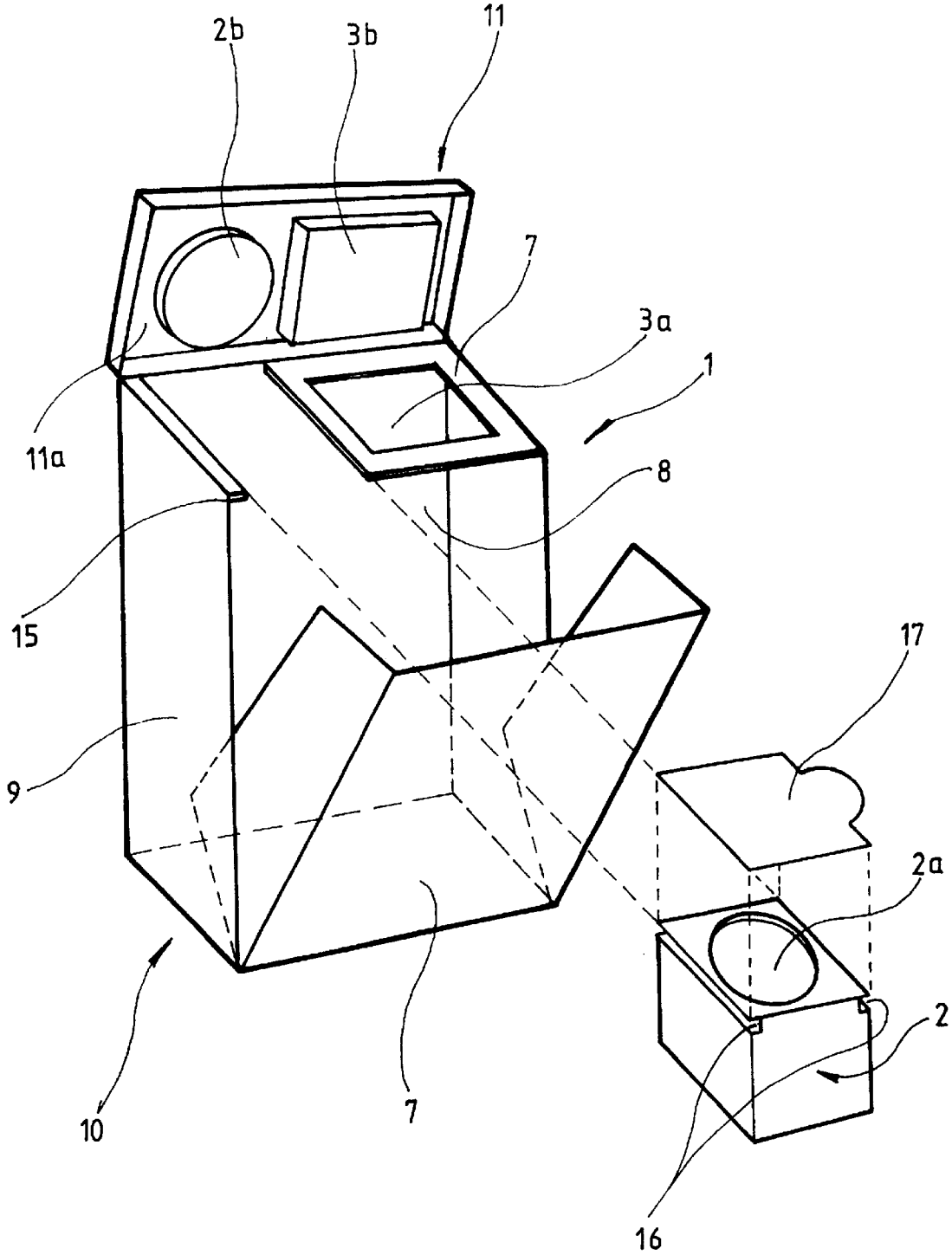
FIG. 2 shows a perspective view of a second illustrative embodiment of the receptacle of the invention.
Figure 3:
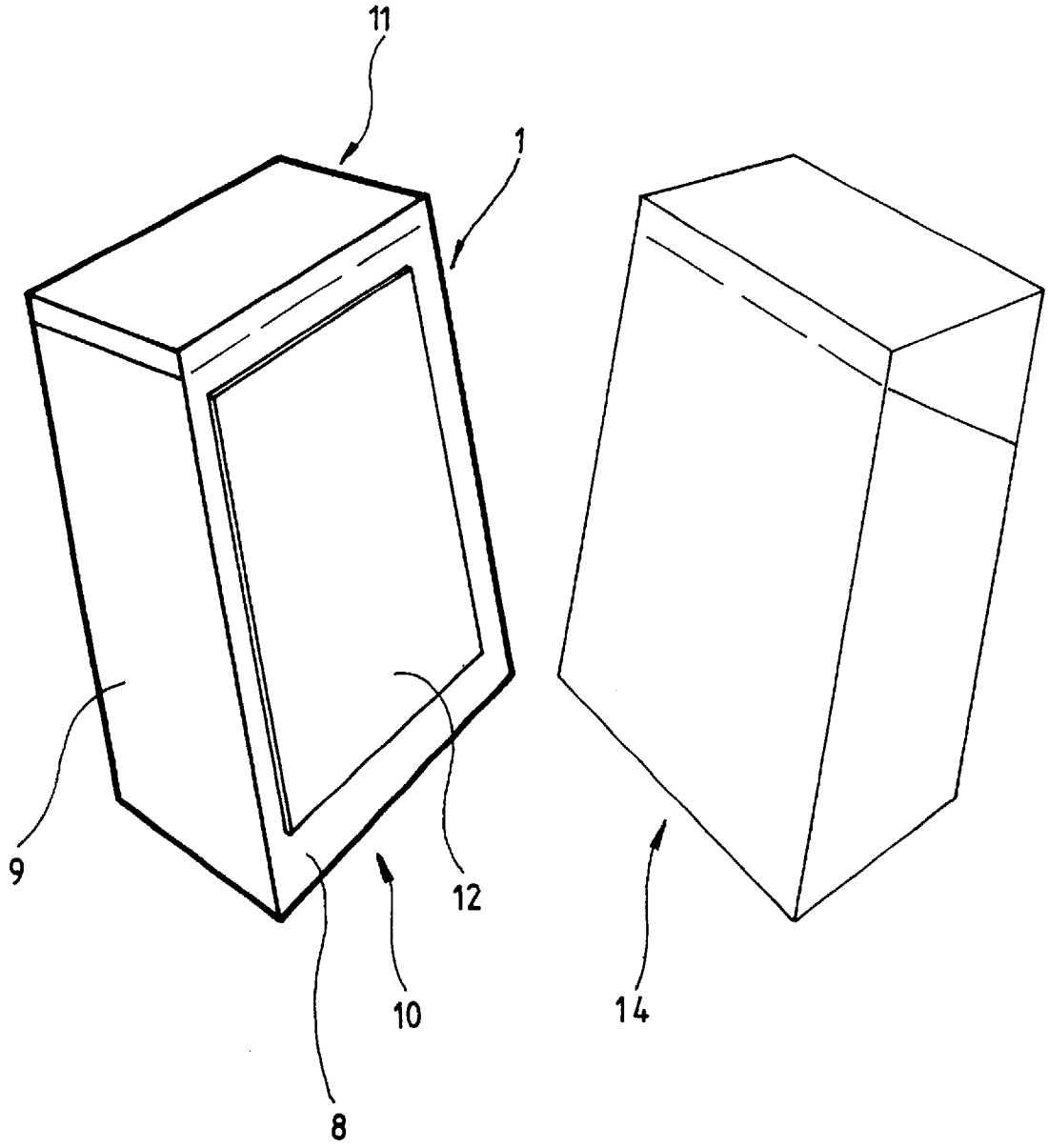
FIG. 3 shows a perspective view of a rear surface of the receptacle of the invention, being provided with a sticker means for fixedly or removably mounting the receptacle onto another surface.

FIG. 2 presents a second, alternative preferred embodiment of the invention, wherein a front surface 8 of the rectangular housing 1 of the receptacle is openable, so as to allow introduction of the independent fire extinguishing substance containing chamber 2, the upper surface of which is equipped with side grooves 16 to effect slidable insertion on members 15 of the top surface 7 of the rectangular receptacle 1, thereby being suspended therefrom. A paper cover 17 is stuck onto the top of the fire extinguishing substance containing chamber 2, the paper cover 17 being removed by the user prior to use of the receptacle. In this second preferred embodiment of the invention, the airtight closure means 4 takes the form of caps 2*b* and 3*b* provided onto the interior surface 11*a* of the cover 11 of the rectangular housing 1 of the receptacle 10, which make a tight fit onto openings 2*a* and 3*a* respectively on the top of the rectangular housing 1 of the receptacle 10.

The receptacle 10 of the invention, having the form either of the first preferred embodiment depicted in FIG. 1 or of the second preferred embodiment depicted in FIG. 2, is provided with an additional surface, which by way of example is shown to be a sticker surface 12 provided onto the rear surface 8 of the receptacle. By means of such a sticker surface 12, the receptacle 10 might be adhered and made available together with a packet of cigarettes 14. Alternatively the same sticker surface 12 might be used to adhere receptacle 10 onto other smoking related articles, such as a lighter, a box of matches, etc. or to fixedly mount the receptacle onto any desired surface, such as by way of example the panel in a motor car or a wall in a building structure of any kind.

Figure 4:
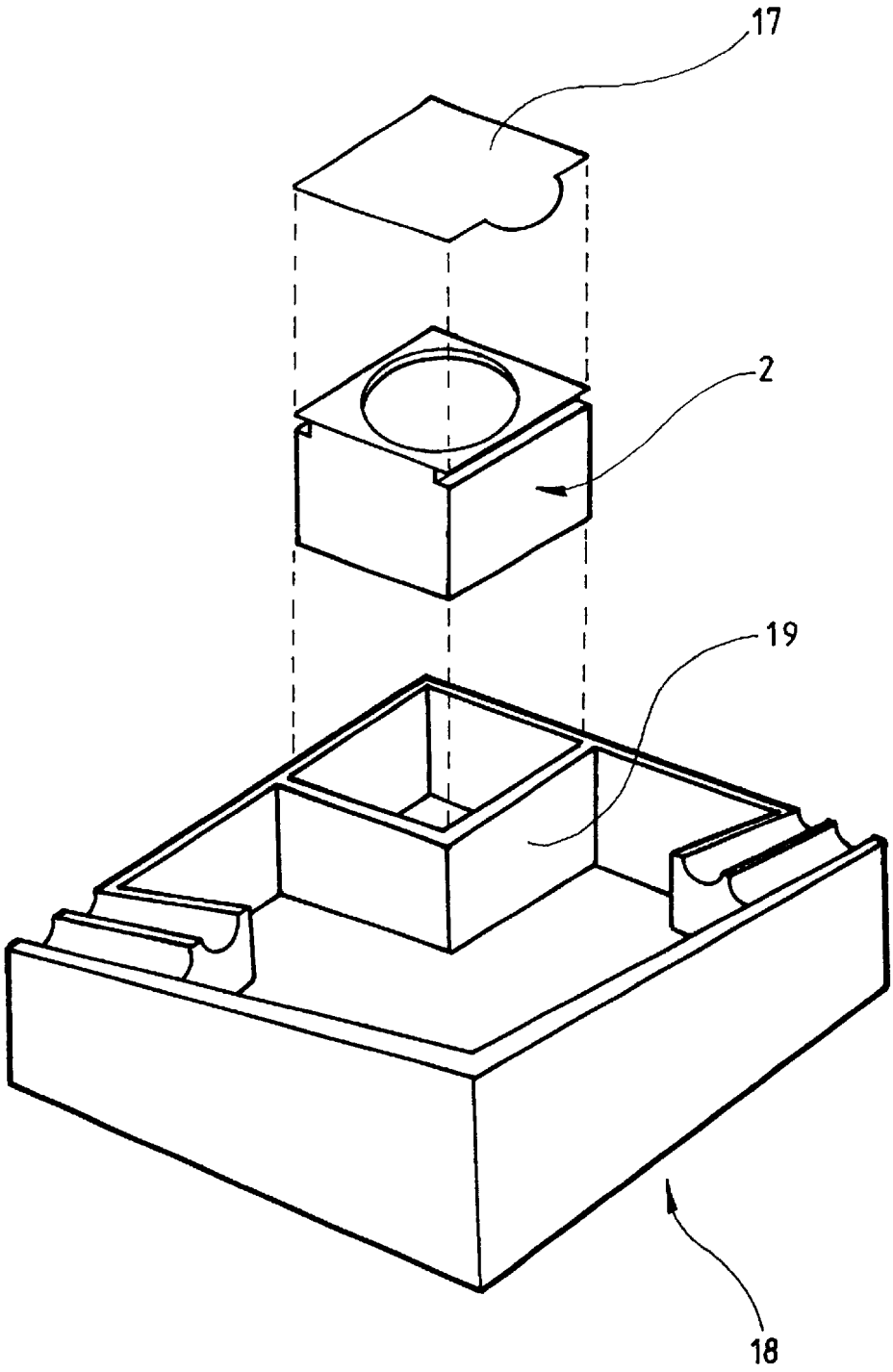
FIG. 4 shows a perspective view of an alternative embodiment of the invention showing the combination of a conventional table ashtray with a fire extinguishing substance containing chamber.

Finally, FIG. 4 depicts the fire extinguishing substance containing chamber 2 of the receptacle being slidably insertable into a correspondingly receiving section 19 of the table ashtray 18, thereby resulting to a novel combination of table ashtray with a fire extinguishing substance containing chamber 2.

The fire extinguishing substance contained in chamber 2 may take the form of a viscous substance, such as a suitable gel compound and the like. An odorous substance may be added in the viscous substance to have a deodorizing effect during usage of the receptacle.

It must hereby be noted that the invention was hereinabove described by reference to illustrative, but non-restrictive embodiments. Any change in dimensions, forms, materials and accessories used, as long as it does not involve a new inventive step is considered part of the scope and aims of the present application.

What is claimed is:

1. Portable receptacle for extinguishing and storing cigarette ends, characterized by that it comprises two distinct, functionally independent, unequally sized chambers, wherein a first smaller chamber (2) is equipped with a viscous gel compound fire extinguishing substance for extinguishing a cigarette through immersion via a first top opening **(2*a*) thereof and a second larger chamber (3) with a second top opening (3*a*) through which ashes during smoking and cigarette ends after their extinguishing in said chamber (2) are collected for disposal, wherein said receptacle has the form of a rectangular housing (1) which is closed by a rotatable top cover (11), said rectangular housing (1) being formed by a pair of relatively large parallel front and rear surfaces (8), a pair of relatively small parallel side surfaces (9) and a pair of parallel top and bottom surfaces (7) which, when said top cover (11) is closed, acquire a parallel orientation in relation to the upper surface (11*a*) of the top cover (11), wherein said first smaller chamber (2) is provided with side grooves (16) by means of which said chamber (2) is slidably inserted into members (15) of the top surface (7) of said rectangular housing (1) through the openable front surface (8) thereof and is suspended therefrom, and wherein additional closure means (4) is provided for airtightly closing said first and second top openings (2*a*, 3*a*)** and thereby eliminate dispersion of unpleasant odours in the environment.

2. Portable receptacle for extinguishing and storing cigarette ends, according to above claim 1, wherein a removable paper cover (17) is stuck onto the top of the viscous gel compound fire extinguishing substance containing said first smaller chamber (2), said paper cover (17) being removed by the user prior to use of the receptacle.

3. Portable receptacle for extinguishing and storing cigarette ends, according to above claim 1, wherein said closure means (4) comprises a sideways extending surface (5) connected to the bottom surface (7) of the rectangular housing (1) of the receptacle and extending to an upper surface (6) which is slidably inserted on top of the top surface (7) of the rectangular housing (1) of the receptacle to cover said first and second top openings **(2*a*,3*a*) and wherein a handling fixture (13) extends at the junction of said sideways extending and upper surfaces (5,6) of the closure means (4) to facilitate operating of the closure means (4)**.

4. Portable receptacle for extinguishing and storing cigarette ends according to the above claim 1, wherein said closure means (4) takes the form of caps **(2*b*) and (3*b*) provided onto the interior of said cover (11) of the rectangular housing (1) of the receptacle (10) which make a tight fit onto said first and second top openings (2*a*,3*a*) respectively on the top of the rectangular housing (1)** of the receptacle.

5. Portable receptacle for extinguishing and storing cigarette ends according to the above claim 1, wherein any surface of said rectangular housing (1) of receptacle (10) is provided with a sticker surface (12), said sticker surface (12) constituting the means for adhering and fixedly mounting said receptacle onto: a packet of cigarettes (14), a lighter, a box of matches, a motor car driving panel, a wall panel in a building structure.

6. Portable receptacle for extinguishing and storing cigarette ends according to the above claim 1, wherein the independent said first chamber (2) containing the viscous gel compound fire extinguishing substance is slidably insertable into a correspondingly receiving section (19) of a table mounted ashtray (18).

7. Portable receptacle for extinguishing and storing cigarette ends according to the above claim 1, wherein said viscous gel compound fire extinguishing substance includes an odorous substance to have a deodorizing effect during usage of the receptacle.

* * * * *